US007892029B2

(12) United States Patent
Wang et al.

(10) Patent No.: US 7,892,029 B2
(45) Date of Patent: Feb. 22, 2011

(54) ELECTRICAL CONNECTOR WITH A ROTATING METAL SHELL

(75) Inventors: Hong-Fang Wang, Kunshan (CN); Ming Zhang, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/607,084

(22) Filed: Oct. 28, 2009

(65) Prior Publication Data

US 2010/0159728 A1 Jun. 24, 2010

(30) Foreign Application Priority Data

Dec. 23, 2008 (CN) ..... 2008 1 0306457

(51) Int. Cl.
*H01R 13/648* (2006.01)

(52) U.S. Cl. ..... 439/607.32

(58) Field of Classification Search . 439/607.32–607.4, 439/312, 331, 326
See application file for complete search history.

(56) References Cited

U.S. PATENT DOCUMENTS

| | | | | |
|---|---|---|---|---|
| 4,456,318 | A * | 6/1984 | Shibata et al. | 439/68 |
| 5,961,338 | A * | 10/1999 | Wu et al. | 439/326 |
| 6,302,736 | B1 * | 10/2001 | Nishio et al. | 439/596 |
| 6,722,909 | B1 * | 4/2004 | McHugh et al. | 439/331 |
| 6,726,497 | B2 * | 4/2004 | Nogawa et al. | 439/260 |
| 6,743,035 | B1 * | 6/2004 | Yang | 439/326 |
| 6,761,575 | B2 * | 7/2004 | Bricaud et al. | 439/326 |
| 6,805,570 | B1 * | 10/2004 | Lee | 439/326 |
| 6,884,102 | B2 * | 4/2005 | Rumpel et al. | 439/331 |
| 6,890,203 | B2 * | 5/2005 | Matsunaga et al. | 439/331 |
| 7,044,773 | B2 * | 5/2006 | Suzuki et al. | 439/495 |
| 7,083,454 | B2 * | 8/2006 | Suzuki | 439/260 |
| 7,160,129 | B2 * | 1/2007 | Yin | 439/331 |
| 7,161,811 | B2 * | 1/2007 | Richter | 361/737 |
| 7,270,559 | B1 * | 9/2007 | Chen | 439/326 |
| 7,361,048 | B2 * | 4/2008 | Shimada | 439/492 |
| 7,384,294 | B2 * | 6/2008 | Washino et al. | 439/326 |
| 7,404,727 | B1 * | 7/2008 | Lee et al. | 439/326 |
| 7,435,119 | B2 * | 10/2008 | Chang et al. | 439/188 |

(Continued)

FOREIGN PATENT DOCUMENTS

| | | |
|---|---|---|
| TW | M326255 | 1/2008 |

*Primary Examiner*—T C Patel
*Assistant Examiner*—Vladimir Imas
(74) *Attorney, Agent, or Firm*—Wei Te Chung; Andrew C. Cheng; Ming Chieh Chang

(57) ABSTRACT

An electrical connector includes: an insulating housing defining a mounting face for being mounted on a PCB and a pair of engaging portions at two opposite ends of the insulating housing; a number of contacts retained in the insulating housing; a metal shell assembled on the insulating housing along an assembly direction slanting to the mounting face, the metal shell having a locking portion with a gap through which the engaging portion is inserted in the locking portion and a stopper portion. The stopper portion exceeds the mounting face when the metal shell assembled on the insulating housing along the assembly direction before the electrical connector is mounted on the PCB, while the stopper portion is pressed by the PCB to offset the assembly direction when the electrical connector is mounted on the PCB so as to prevent the engaging portion from deflecting from the locking portion through the gap.

19 Claims, 6 Drawing Sheets

U.S. PATENT DOCUMENTS

| | | | | |
|---|---|---|---|---|
| 7,591,661 | B2 * | 9/2009 | Suzuki et al. | 439/260 |
| 7,607,947 | B1 * | 10/2009 | Ho | 439/607.36 |
| 7,708,598 | B2 * | 5/2010 | Hu | 439/630 |
| 2003/0092305 | A1 * | 5/2003 | Takeuchi | 439/342 |
| 2005/0070146 | A1 * | 3/2005 | Lu | 439/326 |
| 2005/0196994 | A1 * | 9/2005 | Bilcauu et al. | 439/326 |
| 2005/0245120 | A1 * | 11/2005 | Yin | 439/331 |
| 2005/0245136 | A1 * | 11/2005 | Yin et al. | 439/630 |
| 2007/0117463 | A1 * | 5/2007 | Washino et al. | 439/630 |
| 2008/0124964 | A1 * | 5/2008 | Chen | 439/326 |
| 2009/0149071 | A1 * | 6/2009 | Yu et al. | 439/631 |
| 2009/0221174 | A1 * | 9/2009 | Matsumoto et al. | 439/374 |

* cited by examiner

ELECTRICAL CONNECTOR WITH A ROTATING METAL SHELL

BACKGROUND OF THE INVENTION

1. Field of the Invention

The present invention relates to an electrical connector having a rotating metal shell and mounted on a PCB.

2. Description of Related Art

An electrical connector used in an electronic device usually has a shielding member to protect the electrical connector for EMI. As disclosed in TW Pat. No. 326255, an electrical connector includes a longitudinal insulating housing, a plurality of contacts retained in said insulating housing to be mounted on a PCB and a longitudinal shielding member covering on said insulating housing. The shielding member includes a bottom shell and a top shell rotatable engaging with said bottom shell between an open position and a closed position. Said top shell has a first engaging portion engaging with said bottom shell and a second engaging portion engaging with insulating housing after the top shell rotates to the closed position. Said insulating housing is assembled into a retaining space defined by said bottom shell and said top shell therebetween. And then the top shell rotates to the closed position to securely engage with the insulating housing by the second engaging portion. However, said top shell and said bottom shell has a complicated structure and should engages with each other before the insulating housing is assembled into the retaining space, which reduce the efficiency of the assembly procedure.

So it is necessary to provide a new electrical connector to solve the problems above.

SUMMARY OF THE INVENTION

Accordingly, it is an object of the present invention to provide an electrical connector with a rotatable metal shell which is conveniently assembled.

In order to achieve above-mentioned object, an electrical connector is provided and comprises: an insulating housing defining a mounting face for being mounted on a PCB and a pair of engaging portions at two opposite ends of the insulating housing; a plurality of contacts retained in said insulating housing; a metal shell assembled on the insulating housing along an assembly direction slanting to the mounting face, said metal shell having a locking portion with a gap through which the engaging portion is inserted in the locking portion and a stopper portion. The stopper portion exceeds the mounting face when the metal shell assembled on the insulating housing along said assembly direction before the electrical connector is mounted on the PCB, while the stopper portion is pressed by the PCB to offset the assembly direction when the electrical connector is mounted on the PCB so as to prevent the engaging portion from deflecting from the locking portion through the gap.

Other objects, advantages and novel features of the present invention will become more apparent from the following detailed description of the present embodiment when taken in conjunction with the accompanying drawings.

DETAILED DESCRIPTION OF THE INVENTION

Figure 1:
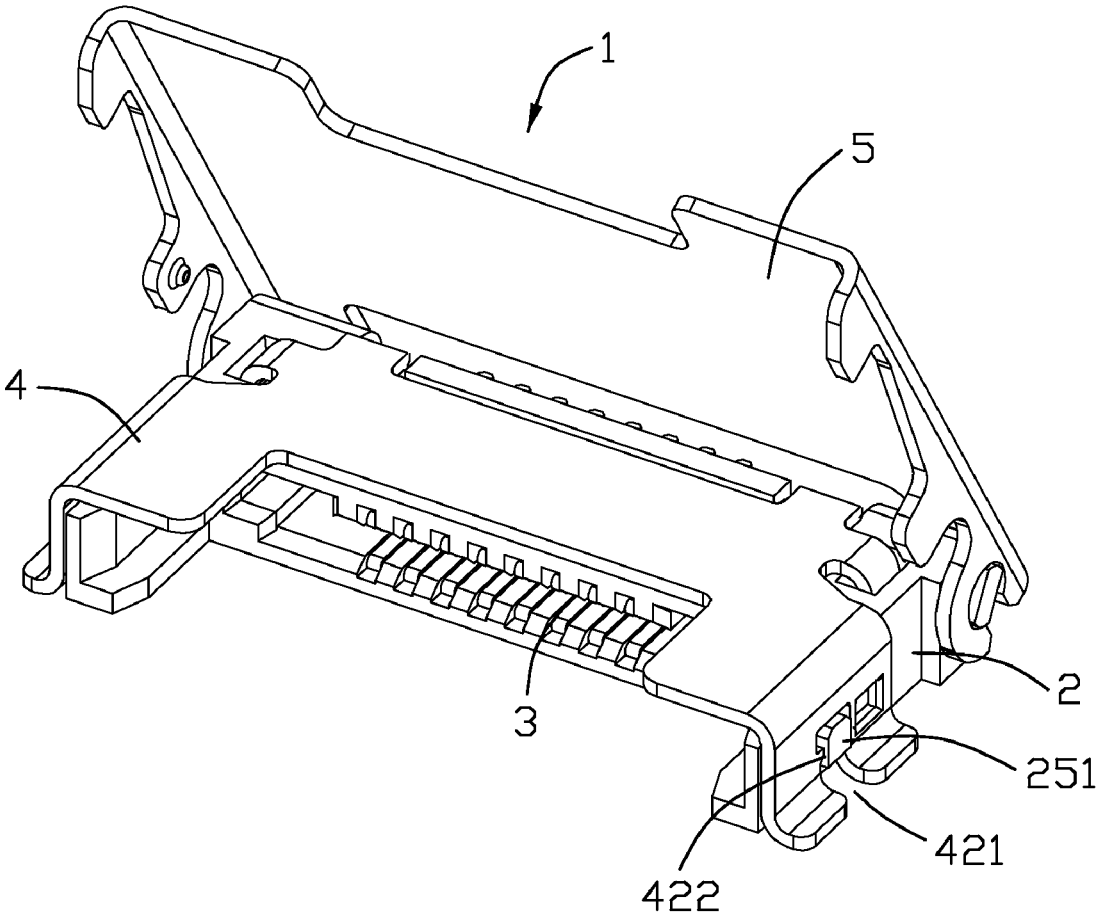
FIG. 1 is an assembled perspective view of an electrical connector in accordance with the present invention.

The present invention shall be discussed hereinafter in terms of a preferred embodiment illustrated in the accompanying drawings. In the following description, numerous specific details are set forth in order for the reader hereof to gain a thorough understanding of the present invention. It will be obvious, however, to those skilled in the art that certain well-know elements may not be shown in detail in order to unnecessarily obscure the present invention.

Referring to FIGS. 1 to 6, an electrical connector 1 with a mounting face M for being electrically mounted on a PCB 6 includes an insulating housing 2, a plurality of contacts 3, a first shell 4 assembled on the insulating housing 2 and a second shell 5 covered on said insulating housing 2 and first shell 4 to rotate between an open position and a closed position. The electrical connector 1 mates with a counterpart connector along a mating direction.

Figure 2:
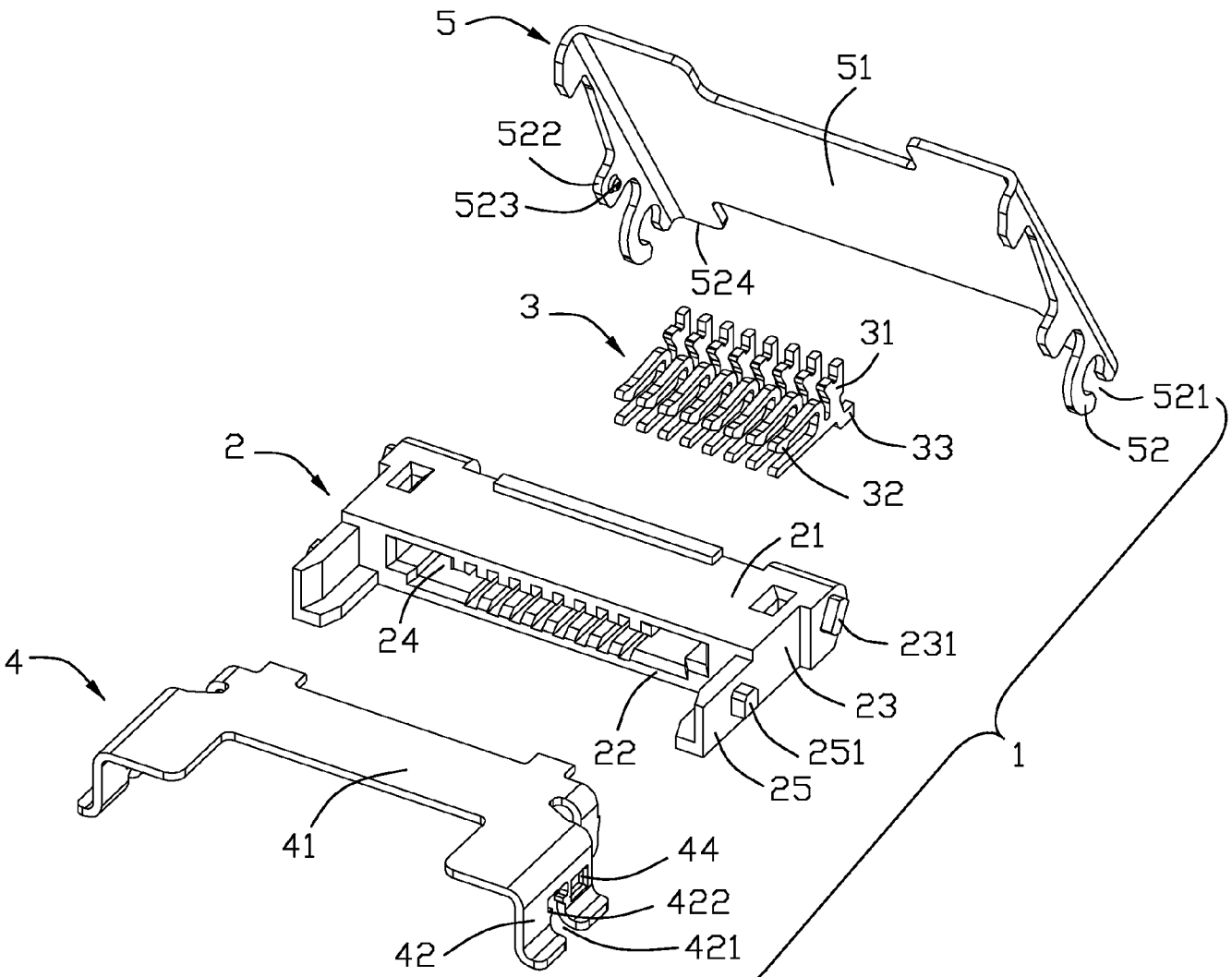
FIG. 2 is an exploded perspective view of the electrical connector of FIG. 1.
Figure 3:
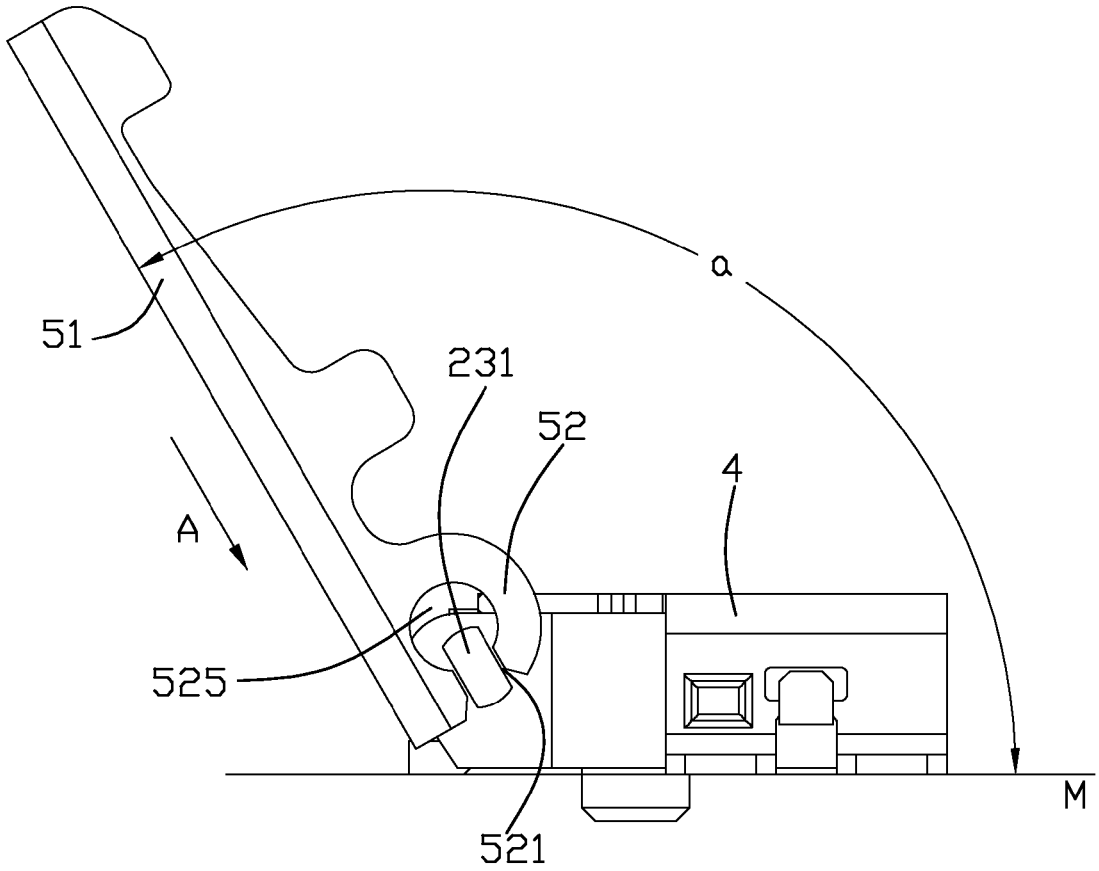
FIG. 3 is a side view of the electrical connector of FIG. 1 during the second shell is assembled on the insulating housing.
Figure 4:
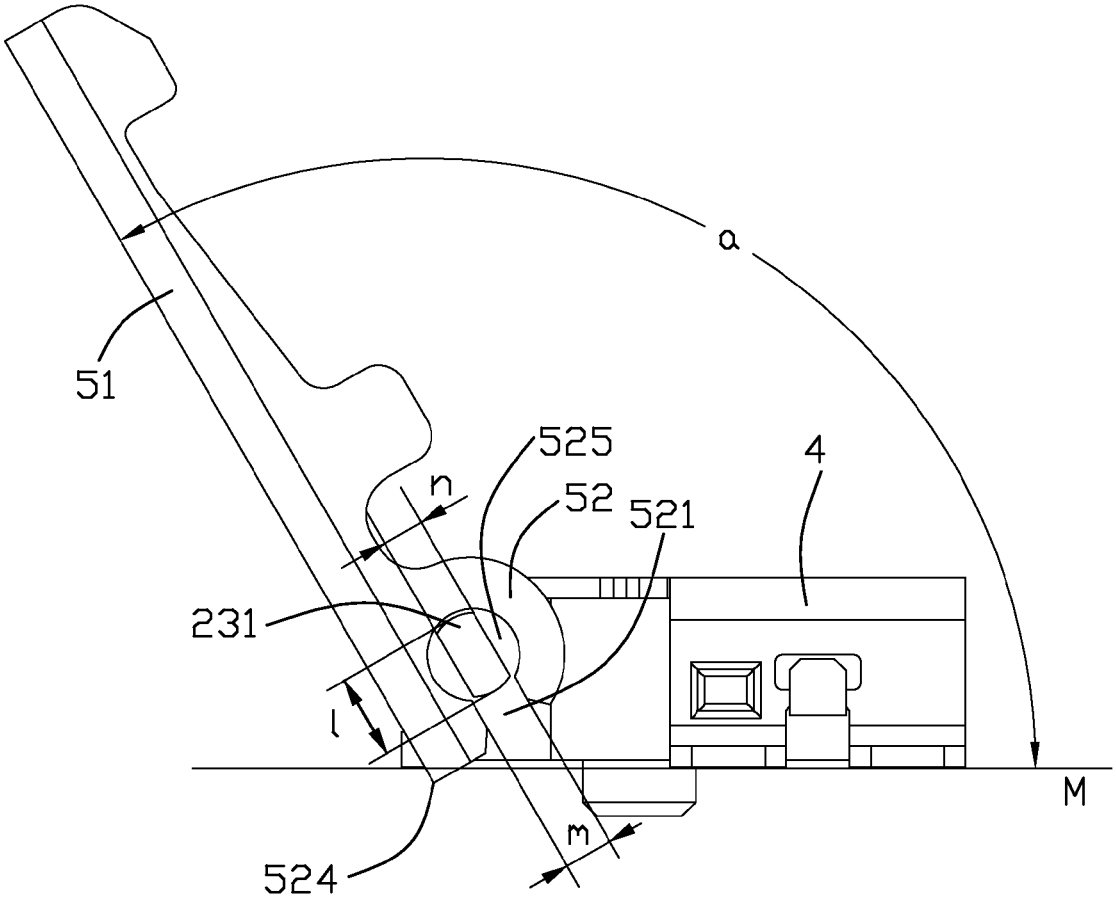
FIG. 4 is a side view of the electrical connector of FIG. 3 after the second shell is assembled on the insulating housing along an assembly direction A.

In FIG. 2 and FIG. 3, said insulating housing 2 includes a top wall 21, a bottom wall 22 and a pair of sidewalls 23 connected with the top wall 21 and the bottom wall 22 to commonly define a longitudinal mating groove 24 thereamong for receiving a counterpart connector. The bottom wall 22 and the top wall 21 defines a plurality of passageways facing the mating groove 24 to receive the contacts 3. The sidewalls 23 define a pair of latches 25 extending horizontally along the mating direction to guide the counterpart connector and engage with the first shell 4. Said sidewall 23 has an engaging portion 231 protruding outwardly from an outer surface thereon to engage with the second shell 5. Said engaging portion 231 is of a slantwise rectangle rib with a traverse width n and a length 1 (as shown in FIG. 4) to make an angle with the horizontal PCB 6. Said latch 25 has a protruding block 251 projecting from an outer surface thereon to engage with the shell member 4.

In FIG. 2, said contacts 3 are retained in the passageways of the insulating housing 1 and include a retaining beam 31, a contacting beam 32 extending into the receiving groove 24 and a soldering leg 33 horizontally extending from said retaining beam 31 to be soldered on the PCB 6. The contacts 2 are assembled into the insulating housing 2 from backwards.

The first shell 4 is assembled on the insulating housing 1 to cover the top wall 21 and the latches 25 from a top side and includes a horizontal plate 41 and a pair of mounting flanges 42 extending downwardly from two ends of said horizontal plate 41. Said mounting flange 42 defines a retaining slot 421 receiving said protruding block 251 of the latch 25 and a pair of retaining tabs 422 extending into the retaining slot 421 to engage with the protruding block 251.

Figure 6:
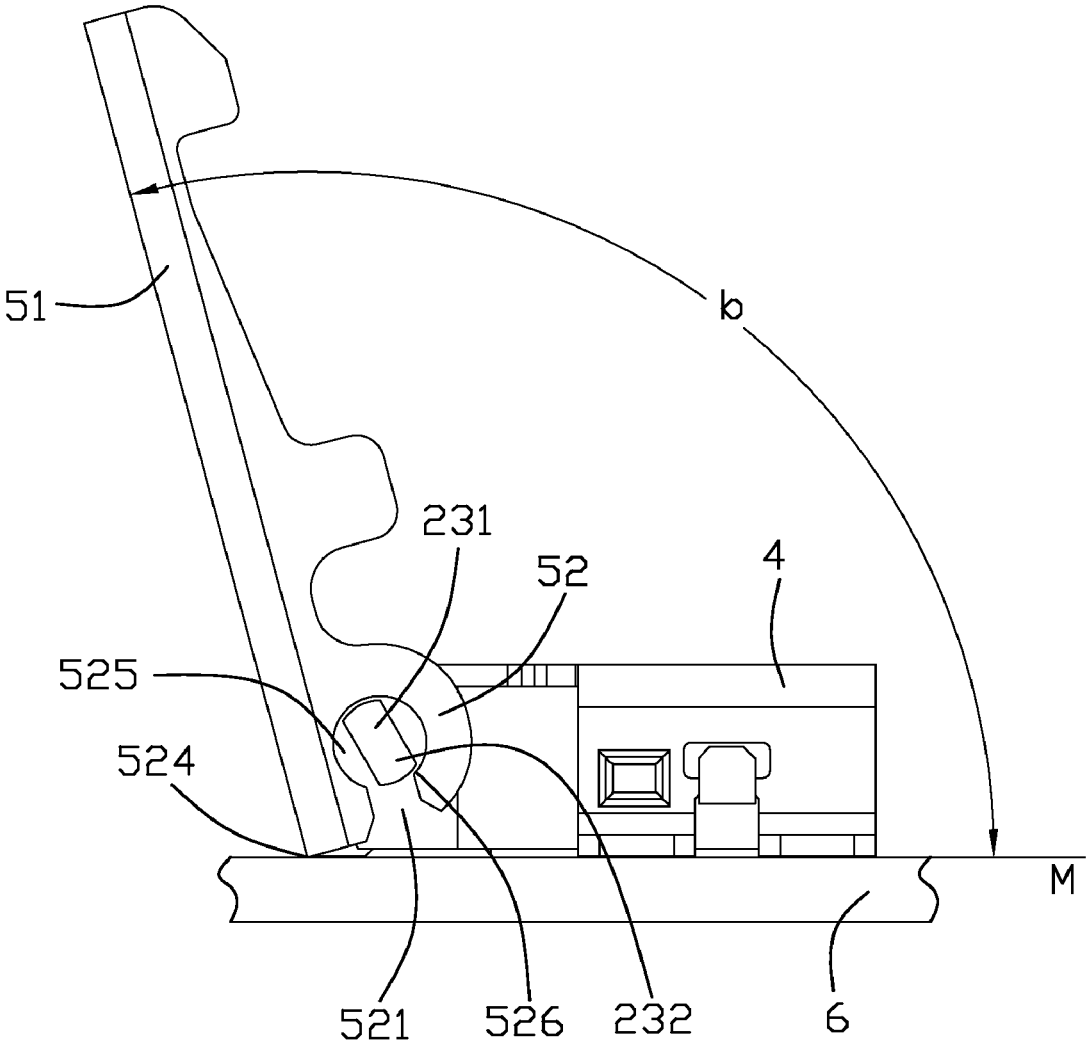
FIG. 6 is a perspective view of the electrical connector of FIG. 5 when the second shell rotates to an open position.

As referring to FIGS. 2 and 4, the second shell 5 is made of a metal plate and has a base portion 51 covering on the insulating housing 2 and said first shell 4 and a pair of locking portions 52 downwardly extending from two ends of said base portion 51. Said locking portion 52 of a hook shape defines a retaining aperture 525 with a gap 521 to rotatably retain the engaging portion 231. The gap 521 has a width m which is appreciably wider than the traverse width n of the engaging portion 231 to allow the engaging portion 231 to engage into the retaining aperture 525 through the gap 521 along an assembly direction A as shown in FIG. 3. The retaining aperture 525 has a circle inner surface 526 as shown in FIG. 6 so that the engaging portion 231 can rotatably engage with the retaining aperture 525 of the locking portion 52 while the second shell 5 rotates between the open position and the closed position. Said second shell 5 further includes a pair of locking tabs 522 with a locking dimple 523 extending inwardly from an inner surface thereon to engage with notches 44 of the first shell 4 after the second shell 5 rotates to the closed position. A pair of back stopper portions 524 of the second shell 5 are formed on said base portion 51 adjacent to said locking portions 52 in order to abut against the PCB 6 when the second shell 5 rotates to the closed position.

As shown in FIGS. 3 and 4, the second shell 5 is assembled onto the insulating housing 2 along an assembly direction A which defines an obtuse angle of a to the mounting face M of the electrical connector 1. The gap 521 of the locking portion 52 correspondingly faces to the engaging portion 231 so that the engaging portion 231 of the insulating housing 2 can smoothly engage into the retaining aperture 525 through the gap 521 and rotatably engage with the locking portion 52. As referring to FIG. 4, after the second shell 5 is assembled on the insulating housing 2, said stopper portions 524 of the second shell 5 downwardly exceed the mounting face M before the electrical connector 1 mounted on the PCB 6.

Figure 5:
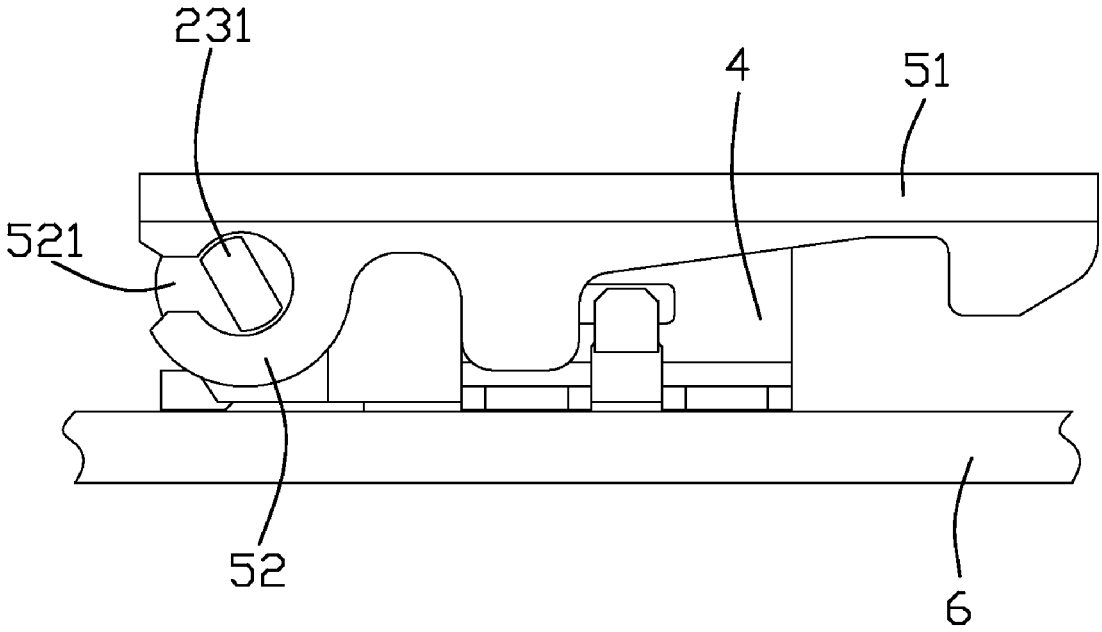
FIG. 5. is a perspective view of the electrical connector of FIG. 4 after mounted on a PCB with the second shell on a closed position.

As a result, after the second shell 5 is assembled on the insulating housing, said electrical connector 1 is mounted on the PCB 6 by the mounting face M, said PCB 6 upwardly abuts against said stopper portions 524 of the second shell 5 and generates a clockwise torque on the second shell 5. In FIG. 6, said locking portion 52 of the second shell 5 rotates clockwise around the engaging portion 231 and drives the second shell 5 clockwise offset from the assembly direction A to change the angle a into a smaller angle of b as shown in FIG. 6. Said angle of b defines the open position of the second shell 5. Meanwhile, the gap 521 rotates clockwise and offsets from the engaging portion 231 so that the engaging portion 231 cannot face to the gap 521, which makes the engaging portion 231 fail to disengage out from the retaining aperture 525 through said gap 521. As referring to FIG. 6, one end 232 of said engaging portion 231 abuts against by the inner surface 526 of the retaining aperture 525 and fails to move out from the retaining aperture 525. Said length 1 of the engaging portion 231 is much wider than the width m of the gap 521 so that the engaging portion 231 can not disengage out from the gap 521 during the second shell 5 rotates between the open position and the closed position. After the second shell 5 rotates to the closed position, as shown in FIG. 5, said engaging portion 231 also fails to disengage from the gap 521 which provides a stable engagement between the second shell 5 and the insulating housing 2. As a result, the second shell 5 can be easily assembled onto the insulating housing 2 and securely engages with the insulating housing 2 once after the electrical connector 1 assembled on the PCB 6.

As well-known to a skilled person in the art, said engaging portion 231 can also be formed on said second shell 5 while the locking portion 52 and the retaining aperture 525 are formed on the insulating housing 2, which is also an embodiment of the present invention.

However, while the preferred embodiment of the invention have been shown and described, it will apparent to those skilled in the art that changes and modifications may be made therein without departing from the spirit of the invention, the scope of which is defined by the appended claims.

What is claimed is:

1. An electrical connector comprising:

an insulating housing defining a mounting face for being mounted on a printed circuit board (PCB) and a pair of engaging portions at two opposite ends of the insulating housing;

a plurality of contacts retained in said insulating housing;

a metal shell assembled on the insulating housing along an assembly direction slanting to the mounting face, said metal shell having a locking portion with a gap through which the engaging portion is inserted in the locking portion and a stopper portion; wherein said stopper portion exceeds the mounting face when the metal shell is assembled on the insulating housing along said assembly direction before the electrical connector is mounted on the PCB, while the stopper portion is pressed by the PCB to offset the assembly direction when the electrical connector is mounted on the PCB so as to prevent the engaging portion from slipping off the locking portion through the gap;

wherein said assembly direction is at an angle beyond 90° with respect to the mounting face.

2. The electrical connector as claimed in claim 1, wherein the metal shell can not reach to said angle during rotation after the electrical connector is mounted on the PCB.

3. The electrical connector as claimed in claim 2, wherein the gap keeps offsetting from the engaging portion during rotating the metal shell between an open position and a closed position after the electrical connector mounted on the PCB.

4. The electrical connector as claimed in claim 3, wherein the gap opens rearward when the metal shell is located at the closed position.

5. The electrical connector as claimed in claim 1, wherein the metal shell is assembled on the insulating housing along said assembly direction in a zero-insertion-force manner.

6. The electrical connector as claimed in claim 5, wherein said engaging portion of the insulating housing is a slantwise rectangle rib with a traverse side and a longitudinal side, the width of the traverse side is narrower than that of said gap of the locking portion, and said gap of the looking portion faces to the transverse side of the engaging portion during the metal shell is assembled onto the insulating housing.

7. The electrical connector as claimed in claim 6, wherein the metal shell comprises a rectangular base portion forming said stopper portion at a distal end thereof and a pair of side walls extending downward from opposite sides of the base portion and forming said locking portion thereon.

8. The electrical connector as claimed in claim 7, wherein another shell is provided under said metal shell and covering on said insulating housing to commonly define a receiving space therebetween.

9. An electrical connector assembly comprising:

an insulative housing defining a mating port thereof;

a plurality of contacts disposed in the housing with contacting sections extending into the mating port;

a polarized engaging portion located around one end of the housing;

a cover pivotally mounted above the housing, said cover including a locking portion pivotally and latchably engaged with the engaging portion in a circumferential manner except at one specific diametrical position/direction compliant with a polarization position of the engaging portion where the locking portion of the cover and the engaging potion are no longer locked to each other; wherein a stopper portion is formed on the cover and has an abutment section located below a bottom face of the housing when said cover is located at said specific diametrical position/direction relative to the housing so as to allow said cover to be assembled to the housing when the housing is essentially in a free standing manner, while said abutment section is urged by an upper surface of a printed circuit board after the housing is mounted to the printed circuit board, thus resulting in a forward rotation of the cover from said specific diametrical position/direction to another one whereby said engaging portion and said locking portion are locked to each other in said circumferential manner so as to prevent the cover from withdrawal from the housing.

10. The electrical connector assembly as claimed in claim 9, wherein said locking portion defines a ring configuration with a gap thereof, while said engaging portion defines a rectangular cross-section and adapted to be radially inserted into a central opening in said ring configuration via said gap only when said cover is located at the specific position/direction relative to the housing.

11. The electrical connector assembly as claimed in claim 10, wherein said rectangular cross-section of said engaging portion extends in an oblique direction which is same with said specific position/direction of the cover relative to the housing.

12. The electrical connector assembly as claimed in claim 9, wherein said cover defines a closed position where the cover is locked and essentially fully shields the housing in a vertical direction, and an open position relative to the housing wherein said cover is essentially fully uncover the housing in said vertical direction, under condition that said open position and said closed position are spaced from each other with an angle larger than 90 degrees with a pivotal range of said cover.

13. The electrical connector assembly as claimed in claim 12, wherein said specific position of the cover is closer to said opening position of the cover while with another angle larger than said angle with regard to the closed position.

14. The electrical connector assembly as claimed in claim 9, wherein a metallic shell is assembled to an upper face of the housing and located between the cover and the housing when said cover is located in the closed position.

15. An electrical connector comprising:

an insulating housing extending along a transverse direction and defining a mating port opened forwardly, and at least one engaging portion located around a rear end of the housing opposite to said mating port;

a plurality of conductive contacts retained in said insulating housing with contacting portions projecting into said mating port;

a metal shell with at least one locking portion and a stopper portion thereon mounted onto the insulating housing in a zero-insertion-force manner at an initial assembling process under condition that said locking portion is in compliance with said engaging portion at a specified exclusive direction so as to allow the locking portion to be assembled onto the engaging portion through a gap defined thereon without any interference, while the stopper portion urges the metal shell to move forwardly if the electrical connector is mounted onto a printed circuit board so as to prevent the metal shell from slipping off the insulating housing.

16. The electrical connector as claimed in claim 15, wherein the locking portion rotates about the engaging portion during the forwardly movement, the locking portion defines a circular inner surface while the engaging portion is with a rectangular configuration.

17. The electrical connector as claimed in claim 16, wherein the engaging portion is immovable and defines the specified exclusive direction.

18. The electrical connector as claimed in claim 17, wherein the insulating housing defines a mounting face thereof, an angle between the specified exclusive direction and the mounting face is above 90°.

19. The electrical connector as claimed in claim 15, wherein the locking portion and the stopper portion are formed at different planes of the metal shell.

* * * * *